US006078761A

United States Patent [19]

de Waal

[11] Patent Number: 6,078,761

[45] Date of Patent: Jun. 20, 2000

[54] DEVELOPMENT UNIT FOR A REPRODUCTION APPARATUS

[75] Inventor: Cornelis Anne de Waal, Nijmegen, Netherlands

[73] Assignee: Oce-Technologies B.V., Netherlands

[21] Appl. No.: 09/330,097

[22] Filed: Jun. 11, 1999

[51] Int. Cl.[7] ..... G03G 15/10

[52] U.S. Cl. ..... 399/61; 399/62; 399/258

[58] Field of Search ..... 399/30, 27, 58, 399/59, 62, 255, 256, 258, 260

[56] References Cited

U.S. PATENT DOCUMENTS 4,462,680 7/1984 Ikeda .
5,006,893 4/1991 Yokoyama .

FOREIGN PATENT DOCUMENTS

0546953A2 6/1993 European Pat. Off. .

OTHER PUBLICATIONS

European Patent Office Publication; Publication Number 62/262070; Publication Date Nov. 14, 1987.

*Primary Examiner*—Matthew S. Smith
*Assistant Examiner*—Greg Moldafsky

[57] ABSTRACT

A development unit for a reproduction apparatus wherein the development unit contains marking agents by means of which prints are made. As a result of making prints, the quantity of marking agents in the development unit decreases. If this quantity decreases below a specific level, then marking agents are fed from a reservoir to the development unit. If at a specific moment circumstances result in a large quantity of marking agents being consumed in a short interval of time, then since resupplying the development unit takes some time there is a momentary a shortage of marking agents in the development unit which is undesirable. By supplying marking agents when a gradient of toner consumption exceeds a specific value, a future shortage is anticipated and the occurrence of a situation in which a shortage of marking agents occurs is considerably reduced.

9 Claims, 7 Drawing Sheets

DEVELOPMENT UNIT FOR A REPRODUCTION APPARATUS

BACKGROUND OF THE INVENTION

The present invention relates to a development unit for a reproduction apparatus for the selective application of marking agents to an image-forming medium comprising: a first reservoir for storing marking agents, a second reservoir for maintaining a working stock of marking agents, transfer means for the selective application of marking agents present in the second reservoir to the image-forming medium, feed means for feeding marking agents from the first reservoir to the second reservoir based on a feed control signal, at least one sensor for the generation of a sensor signal corresponding to the quantity of marking agents present in the second reservoir, and control means for generating the feed control signal on the basis of the sensor signal. The present invention also relates to a reproduction apparatus provided with the development unit.

In a reproduction apparatus, the development unit ensures that marking agents are applied to an image-forming medium. In the case of inkjet, this means the application of ink directly on to the copy material. In the case of electrophotography it involves applying toner to a photoconductor, after which the toner image formed on the photoconductor is transferred to the copy material. If, in the case of electrophotography, the "binary" development system is used, then the marking agents are in the form of a toner powder, with the toner powder being contained, for development purposes, in a development mixture together with carrier particles. During operation, this development mixture is continually maintained in movement, so that the toner particles are charged up tribo-electrically by friction with the carrier particles. A magnetic brush then brings the tribo-electrically charged toner particles into the direct vicinity of the photoconductor, where the toner particles leap over selectively, in accordance with the charge image on the photoconductor, so that a toner image corresponding to the charge image is formed on the photoconductor.

During the production of prints, toner will be consumed from the development mixture so that the quantity of toner in the development mixture and hence the toner concentration of the development mixture decreases. To obtain good prints it is essential that the variation in toner concentration should remain within specific limits. To achieve this, it is known in the prior art to keep the toner concentration at a required value by means of a toner concentration control system which controls the toner supply from a reservoir to the development mixture. However, this objective is only partly achieved. In the case of development units discussed hereinabove, in which marking agents are supplied from a reservoir to a working stock from which the marking agents are withdrawn for development purposes, there is always the risk that the situation may occur where the instantaneous consumption of marking agents exceeds the supply so that a shortage of marking agents occurs in the working stock. In the case of the binary process this means that if more toner is consumed than can be supplied during a specific period of time, the toner concentration falls off. If this fall-off is considerable, the print quality is reduced and when a specific critical bottom limit of toner concentration is reached, soiling and also damage of parts may occur.

To prevent such a critical bottom limit from being reached, it is known in the prior art to go over to a delayed-print mode if the toner concentration reaches a certain threshold value. In this mode the printing operation is temporarily interrupted. All the prints in progress are finished but subsequent prints are no longer accepted. The toner supply continues in the usual way so that the toner concentration can be restored. When the toner concentration has again reached a nominal value, then the flow of prints is put in progress. However, this step does not offer any solution to situations in which the instantaneous toner consumption is so high that the critical bottom limit at which soiling and damage of parts occurs is reached during the finishing of the current print. In order to minimise the negative consequences of such situations, it is known in the prior art to stop printing directly if the critical bottom limit is exceeded, for example by switching of the printhead, so that no more toner is developed while the copy sheet continues to run through normally. The result is an unfinished print. This is undesirable.

Such undesirable situations will occur less rapidly by raising the threshold value at which the printing operation is temporarily interrupted, so that the supply of toner, in between the production of prints, takes place earlier. However, if the threshold is raised, prints will be produced in direct succession to a lesser degree so that productivity falls off. This is also undesirable.

SUMMARY OF THE INVENTION

The object of the invention is to reduce the disadvantages of the above solutions to a far-reaching degree. To this end, the development unit according to the present invention is provided with control means which comprise means for the generation of the feed control signal on the basis of a gradient of the sensor signal.

The invention is based on the realization that in all known systems the supply of marking agents from a reservoir takes place with a certain delay so that if a shortage is found to occur with respect to marking agents in a working stock it cannot be immediately remedied. In these circumstances, a temporarily higher demand for marking agents can be met only if this problem can be anticipated. This is now achieved by including the sensor voltage gradient as a factor in maintaining the quantity of marking agents in the working stock up to a predetermined level. As a result, if the quantity of marking agents in the working stock decreases rapidly, action is taken earlier than if it were just on the basis of the current value of the quantity of marking agents. The advantage of this is that the risk of the printing of a copy sheet having to be interrupted is appreciably reduced. The threshold value can stay lower so that productivity is guaranteed.

In one advantageous embodiment, the generation of the feed control signal, based on the gradient of the sensor signal, takes place only if the sensor signal is within a specific range. As a result, in the event of a temporarily high consumption, corresponding to a large gradient, this prevents unnecessary action being taken in those cases in which the quantity of marking agents present in the working stock is quite adequate to meet the temporarily high consumption.

In another advantageous embodiment, the feed means comprise means for starting and stopping the supply of the marking agents from the first reservoir to the second reservoir on the basis of the feed control signal. As a result, a relatively simple feed mechanism can be used.

Another advantageous embodiment is obtained if the control means also comprise means for generating a signal to initiate a special mode of the reproduction apparatus if the gradient of the sensor signal passes a first threshold value. By bringing the reproduction apparatus into a special mode if the gradient passes a fixed threshold value it is possible to limit the instantaneous toner consumption.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
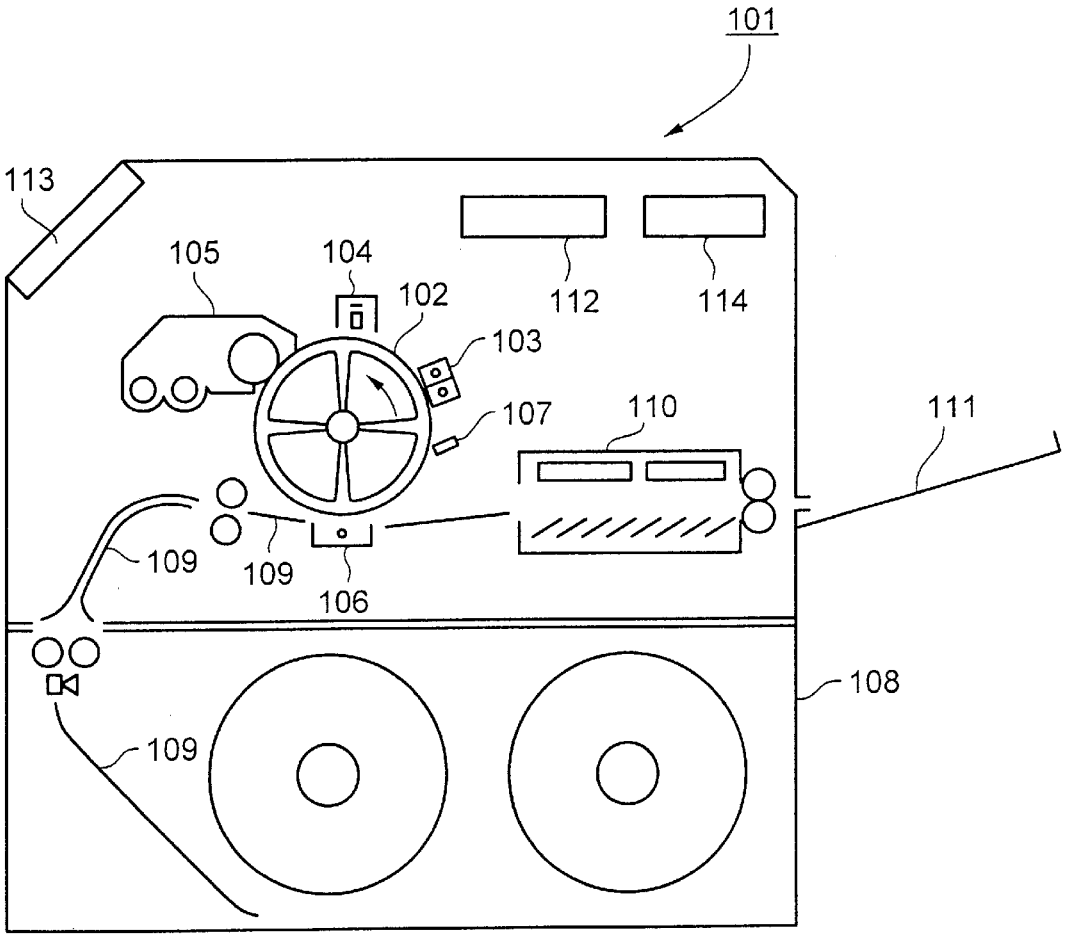
FIG. 1 diagrammatically illustrates a reproduction apparatus provided with a development unit.

FIG. 1 shows an electrophotographic reproduction apparatus 101. The apparatus comprises an image-forming medium constructed as a drum-shaped photoconductor 102 surrounded by, in succession, a charging device 103, an LED array 104, a developing station 105, a transfer station 106 and a cleaner 107. A paper magazine 108 is also provided. A sheet is fed along the transfer station 106 via paper path 109, passes the fixing unit 110 and is delivered in the delivery tray 111. A central control unit 112 ensures that all the above-mentioned functions come into operation at the correct times, effects settings made by a user on the operator control panel 113 and ensures communication with a connected scanner (not shown) and to a network for processing print jobs. During a printing operation, the photoconductor rotates in the direction of the arrow and the region of the photoconductor at the site of the charging device 103 will be charged up to a high negative voltage. The photoconductor then passes the LED array 104. An original image for printing, which is available in electronic form, is fed to the LED array and the latter projects the image (black writer) line-by-line onto the photoconductor. Local conductivity occurs at the places where the photoconductor is exposed and the charge flows away there. In this way a charge image corresponding to the original image is formed on the photoconductor. Toner is applied to the exposed areas as they pass the developing station 105. At the transfer station 106 the toner image is electrostatically transferred to a sheet of copy material fed along the paper path 109 from the paper magazine 108. Cleaner 107 ensures that any toner residues are removed from the photoconductor. The sheet of copy material provided with the toner image is then passed through the fixing unit 110. Here the toner is brought to a temperature such that it will soften and adhere to the copy material. The sheet is then discharged and deposited in the delivery tray 111.

Figure 2:
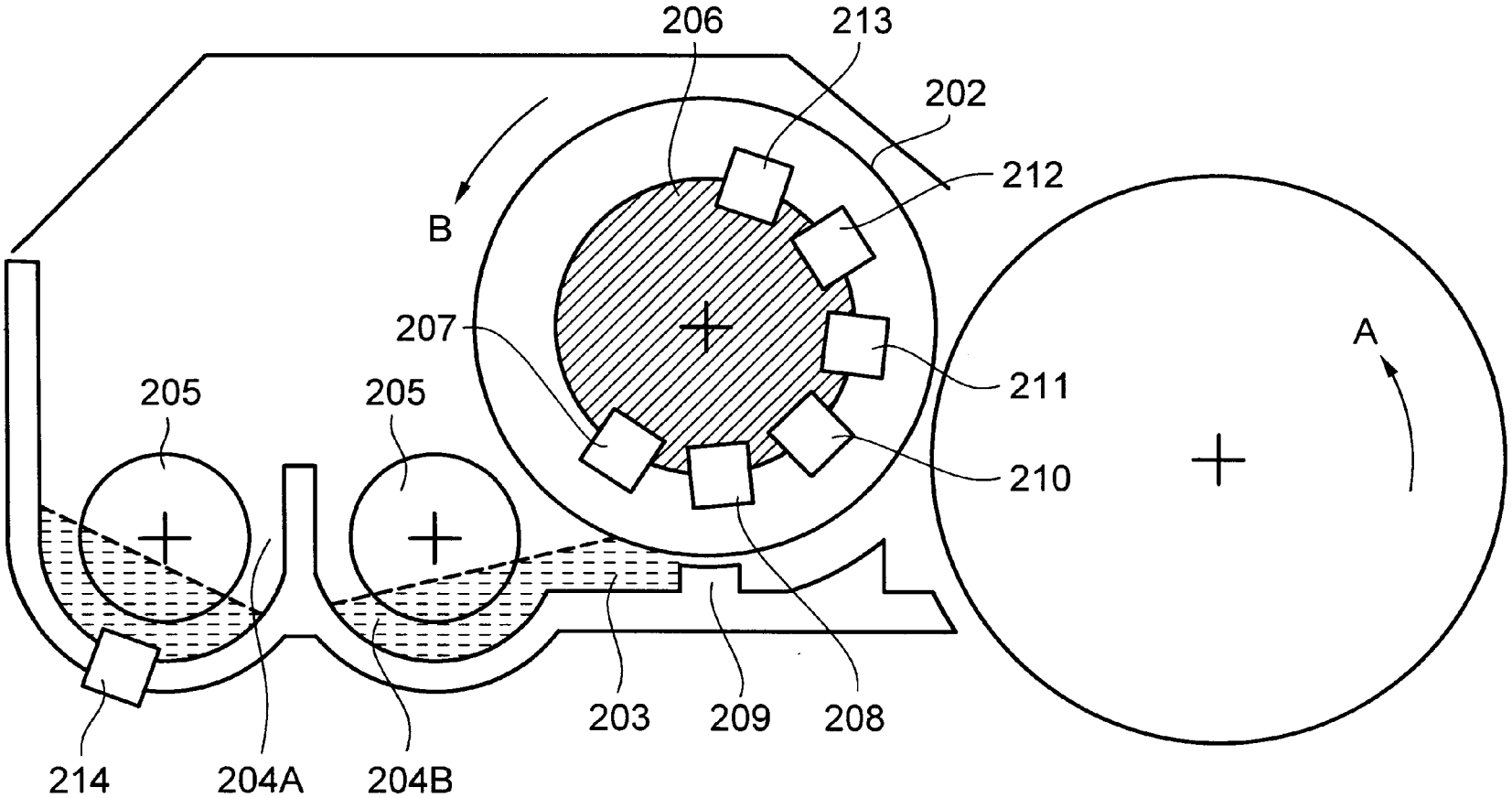
FIG. 2 is a detailed side elevation of the development unit.
Figure 3:
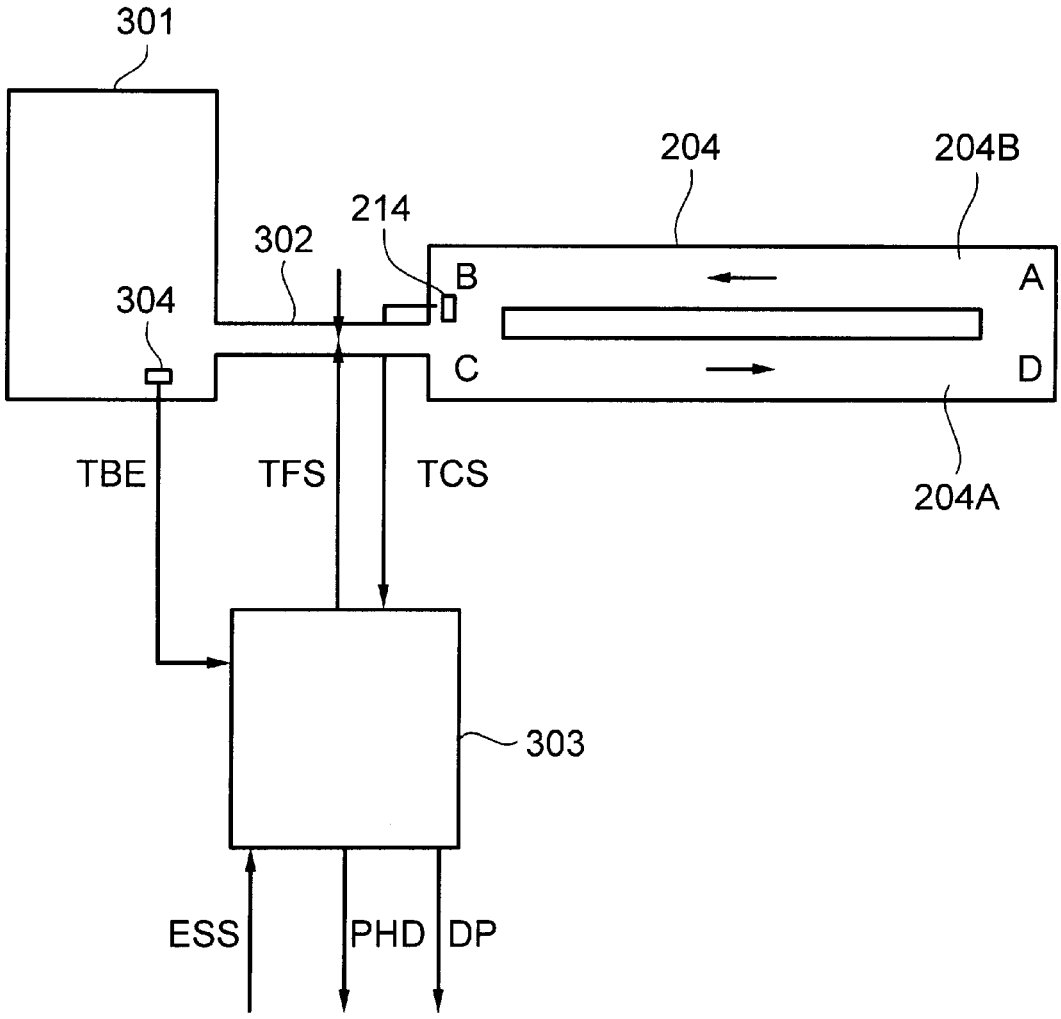
FIG. 3 shows the reservoir tank, reservoir, control system and a number of signals diagrammatically.

The developing station 105 will now be discussed in greater detail with reference to FIGS. 2 and 3. In FIG. 2, the photo-conductive drum, which rotates in the direction of arrow A, is indicated by reference 201. In the embodiment of the reproduction apparatus illustrated, reversal development is used. The reversal developing system comprises a thin cylindrical developing component in the form of an aluminium sleeve 202 positioned parallel to the photoconductive drum 201 so that a narrow gap forming a development zone forms between the surfaces of the sleeve 202 and the photoconductor drum 201. The sleeve rotates in the direction of arrow B, i.e. in the same direction as the photoconductor drum 201, so that the surfaces of the sleeve and the drum in the development zone move in opposite directions to one another. The surface of drum 201 carries a charged image formed thereon in the manner described above and is provided with toner particles in the development zone in accordance with the reversal development method.

A developing mixture 203 consisting of a mixture of carrier particles (e.g. consisting of an iron core provided with resin) and a small quantity of carbon-containing toner particles is present in a reservoir 204. The reservoir consists of two compartments 204A and 204B extending in the longitudinal direction parallel to the photoconductor drum. Each compartment contains a rotating helical screw 205, by means of which the mixture is continuously mixed and by means of which the mixture continuously moves. The bottom part of the peripheral surface of the sleeve extends into the first compartment of the reservoir 204 so that it comes into contact with the development mixture. A magnet system is located in a fixed position inside the sleeve and comprises a cylindrical carrier member 206 and a number of permanent magnets which extend along the internal cylindrical peripheral surface of the sleeve 202.

Magnets 207 and 208 are disposed opposite the reservoir 204 and exert a tractive force on the development mixture 203 in the direction of the surface of the sleeve. Magnet 208 is disposed directly opposite the wiper blade 209. Magnet 210 holds the developer which has passed the wiper blade 209 on the surface of the sleeve, while the latter moves in the direction of the development zone 210. Magnet 211 is positioned directly opposite development zone 210 and forms a magnetic brush which sweeps over the surface of the drum 201 so that the toner particles from the brush are brought into close contact with the surface of the drum 201. Magnets 212 and 213 serve to retain on the sleeve the carrier particles and toner particles not used for the development of the charged image, until they reach the top of the sleeve, from where they drop back into reservoir 204. A toner concentration sensor 214 is disposed in the bottom of the reservoir 204. The sensor 214 periodically delivers a signal which is a measurement of the toner concentration in the development mixture. FIG. 3 shows the reservoir 204 again but now in a diagrammatic top plan view. The two compartments 204A and 204B extend parallel to one another in the longitudinal direction. In operation, the development mixture moves in the direction of the arrow as a result of the rotation of the contra-rotating helical screws, which are not shown in FIG. 3. Toner is fed to the reservoir 204 from the toner supply tank 301 via toner supply spiral 302, which is driven by a toner supply motor (not shown in the drawing). The development mixture with the freshly supplied toner must pass through the entire mixing tank before it reaches the development roller so that good mixing and charging takes place. Toner supply spiral 302 is switched on and off from the control 303 by means of the toner feed signal TFS. The toner concentration sensor 214 is disposed in the direct vicinity of the toner feed opening. The signal TCS thus generated is fed to control unit 303. A converter converts this signal to a digital value suitable for digital processing. This digital value is renewed every 100 ms. The gradient is derived from the progressive average over a period of 20 measurements. A detector 304 in the toner supply tank detects the level of the quantity of toner present in the tank. A signal TBE is delivered if the toner supply is almost used up. A signal ESS is fed to control unit 303 from the main control unit of the reproduction apparatus when a print is to be made. The signals PHD and DP are fed from the control unit 303 to the main control unit when the PrintHead has to be switched off and the reproduction apparatus is to pass to the delayed-print mode, respectively.

Figure 4:
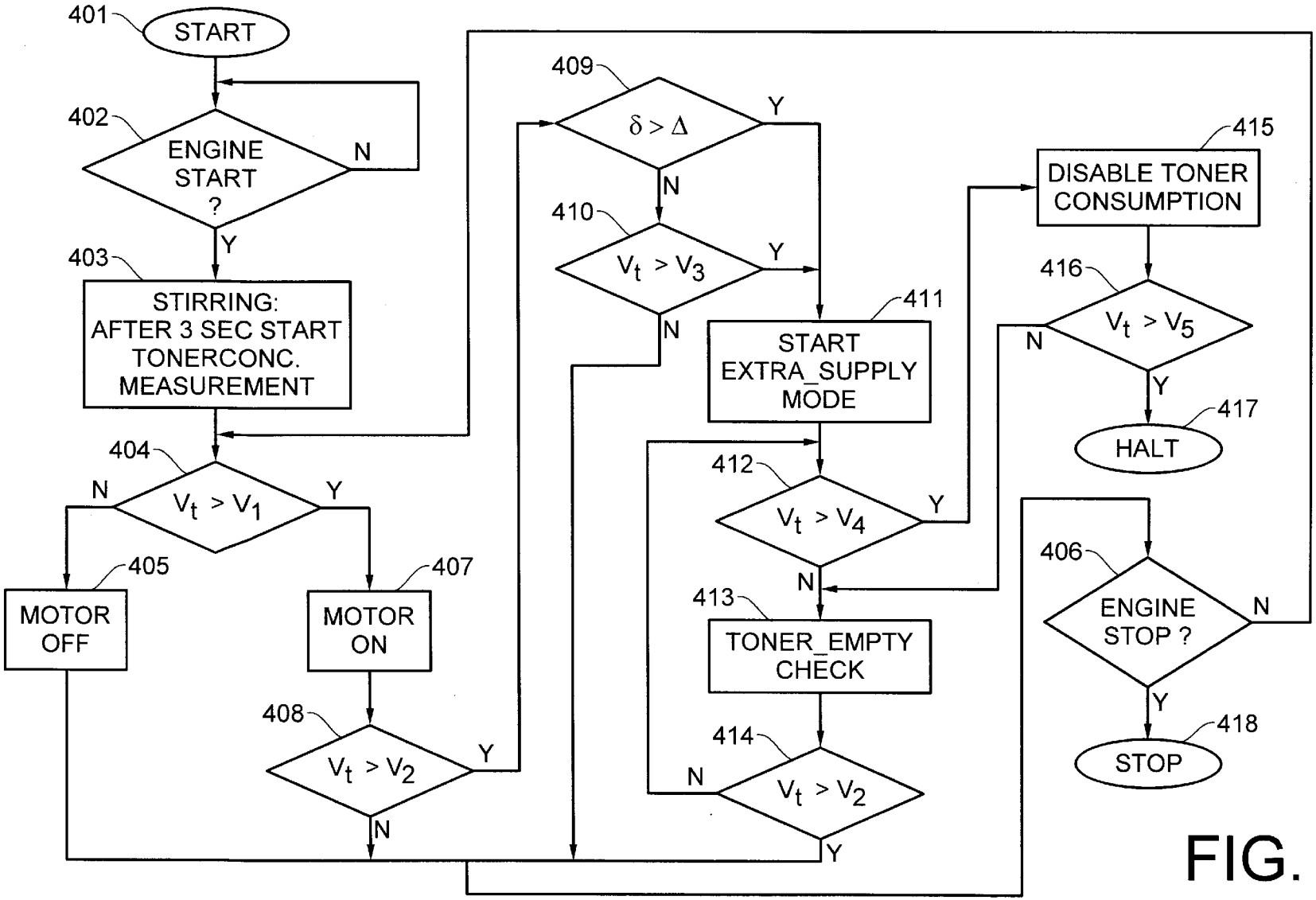
FIG. 4 is a flow diagram of the method according to the present invention.

During development, drum 201 is uniformly charged to a surface potential of −1200 volts. Exposing the drum by means of the exposure unit results in a local discharge so that a charge image is formed on the drum. Sleeve 202 is brought to a bias voltage of −1100 volts. An electric field corresponding to a voltage difference of 100 V occurs in the gap of the development zone at those places on the photoconductive drum which are not exposed and where there is therefore no local discharge. The gap typically has a width in the order of magnitude of 1.5 mm. Since the toner particles have a negative tribo-electric charge, the electric field in the gap will attract the toner particles to the sleeve so that they are not deposited on the unexposed areas of the photoconductor. The exposed areas of the drum have a surface potential of about −700 V. In these areas the electric field will be directed in opposition so that toner particles will be deposited on the discharged areas. It should be clear that the system described here is what is known as a black-writing system, in which the exposed parts of the photoconductor are developed with toner. The toner image developed on the drum is transferred, by electric transfer already described, to a copy sheet, fixed thereon and then delivered. The method according to the present invention will now be described as it is performed in the control unit 303, with reference to the flow diagram shown in FIG. 4.

Starting from step 401, in which the apparatus is in the standby mode, step 402 continuously checks whether a command is received from the central control to the effect that the engine is to start, and this occurs inter alia if a print is to be made. If this is the case (Y), the mixing rollers start to rotate and, after the mixing rollers have rotated 3 seconds, the toner concentration measurement starts (step 403). Step 404 checks whether the toner concentration voltage is higher than a first threshold value $V_1$. If this is not the case, then if the toner supply motor is running the motor is switched off after 4 seconds in step 405. If the motor is not running, then nothing happens in this step. Step 406 checks whether a command has been received from the control to the effect that the engine must stop. If this is not the case (N), step 404 is reached again. As long as the toner concentration voltage is not higher than $V_1$ the loop formed by the steps 404, 405 and 406 is traversed. The toner concentration is adequate, no new toner is fed from the toner supply tank to the development mixture in the development unit reservoir. If step 404 finds that the toner concentration voltage is higher than $V_1$ (Y), then in step 407 the toner supply motor is switched on if it is not yet on. If it is already switched on then it remains on: the toner concentration has a level so low that new toner must be added to the development mixture. Step 408 then checks whether the toner concentration voltage is higher than the threshold value $V_2$. If this is not so (N) step 406 is reached. As long as the toner concentration voltage is between $V_1$ and $V_2$ the loop formed by the steps 404, 407, 408, 406, 404 is traversed. Toner is continuously supplied. Toner supply will be stopped in step 405 only if step 404 finds that the toner concentration is at an adequate level corresponding to a toner concentration voltage lower than or equal to $V_1$. If the toner concentration voltage is higher than $V_1$ and if step 408 finds that the toner concentration voltage is also higher than $V_2$, then step 409 checks whether the gradient δ is higher than Δ V/sec. If this is not the case (N), step 10 checks whether the voltage is higher than the threshold value $V_3$. If this is not the case (N), step 406 is again reached. This means that if the voltage has a value between the threshold value $V_2$ and the threshold value $V_3$, the loop formed by the steps 404, 407, 408, 409, 410, 406, 404 is traversed. In this loop there is a continual check on the gradient. If the gradient is exceeded (step 409, Y), the apparatus comes into a delayed-print mode (step 411). This mode is also reached if step 410 finds that the voltage is higher than the threshold value $V_3$ (Y). In the delayed-print mode the toner concentration is again brought up to level. It is apparent, given the consumption conditions, that just letting the toner supply motor run is not sufficient to compensate for the consumption. In the delayed-print mode, therefore, the starting of new prints is prohibited; prints in progress, i.e. prints for which the paper is already present in the paper path, are finished. After the start of the delayed-print mode in step 411 step 412 checks whether the voltage is higher than the threshold value $V_4$. If this is not the case (N), then in step 413 a tonerbottle_empty procedure is carried out. This procedure checks whether there is still sufficient toner present in the toner supply tank. If this is not the case, the operator is warned that toner must be added. The procedure is not continued with step 414 until toner really has been added. If the toner supply is sufficient, then the method directly passes onto step 414. In this step a check is made as to whether the toner concentration voltage is lower than $V_2$ and this remains for a certain adjustable time window defined by a timer. If this is not the case (N), the method remains in the loop formed by the steps 412, 413, 414, during which time toner is continually added while no new prints are made. The toner concentration thus has an opportunity of being restored. If in the delayed-print mode in step 412 it is found that the voltage is higher than the threshold value $V_4$ (Y), then in step 415 action is taken to stop the toner consumption directly. For this purpose, for example, all the adjustment voltages of the photoconductor and development unit are brought to zero. In the case of a black writer it is possible to switch off the printhead. Copy sheets which are partially or not completely printed are discharged. Step 416 then checks whether the voltage is higher than the threshold value $V_5$. If this is the case, the apparatus is brought into an emergency mode (step 417), which can only be remedied by a service engineer. If the voltage is not higher than the threshold value $V_5$ (N), the method continues with step 413 and then step 414. If it is found in step 414 that the toner concentration has been restored to an extent such that the voltage remains constantly beneath the threshold value $V_2$ during the time window (Y), the delayed-print mode is cancelled and step 406 is reached. New prints can then again be processed. If step 406 finds that a signal really has been received to the effect that the engine can pass to the standby mode (Y), then the method stops (step 418) and the apparatus returns to the standby mode.

If, with the configuration according to the present invention, prints are made with a nominal degree of coverage, which means that the threshold value of the gradient is not exceeded, then after the production of a number of prints the toner concentration will have dropped to such an extent that the threshold value of $V_1$ is exceeded by the toner concentration voltage. At that time the toner supply motor starts and toner is supplied to the development mixture. In view of the transit time in the reservoir 204 (FIG. 3), it takes some time before the effects thereof are perceptible. Development continues and the toner concentration will thus decrease further. If the threshold value $V_2$ is also exceeded, then from that time on the gradient δ is also checked. In the case of prints with an average degree of coverage, the threshold Δ for the gradient is not exceeded so that the printing continues in the ordinary way. At a certain time an equilibrium will form in which the average supply of toner is in equilibrium with the average delivery of toner by the development brush. After all the prints have been made the method stops and the apparatus passes to the standby mode.

If, with the configuration according to the present invention, prints are made with a high degree of coverage, then the toner concentration voltage will rapidly rise. Starting from an initial value $V_0$ of the toner concentration voltage, the threshold value $V_1$ will first be passed, so that supply of toner to the development mixture starts. However, the effects of this will not be immediately perceptible. At the time that the threshold $V_2$ is passed, a check is made on the gradient. Assuming that the threshold value is exceeded by the gradient, the system passes to the delayed-print mode. This action does have a direct effect, at least after the current print has been finished. The following prints are not continued until the toner concentration is again at a nominal level and the delayed-print mode is terminated.

The effect thus achieved is that in the case of prints having a high degree of coverage action is already taken at an earlier stage than would be possible on the basis of a threshold value for the toner concentration alone and without the behaviour of the apparatus for prints with a nominal degree of coverage changing in these conditions.

The advantages of the present invention will now be explained with reference to a number of examples, in which the curve of the toner concentration voltage $V_t$ is shown diagrammatically in FIGS. 5, 6 and 7. In these examples it has been assumed that the mixing rollers rotate the entire time.

Figure 5:
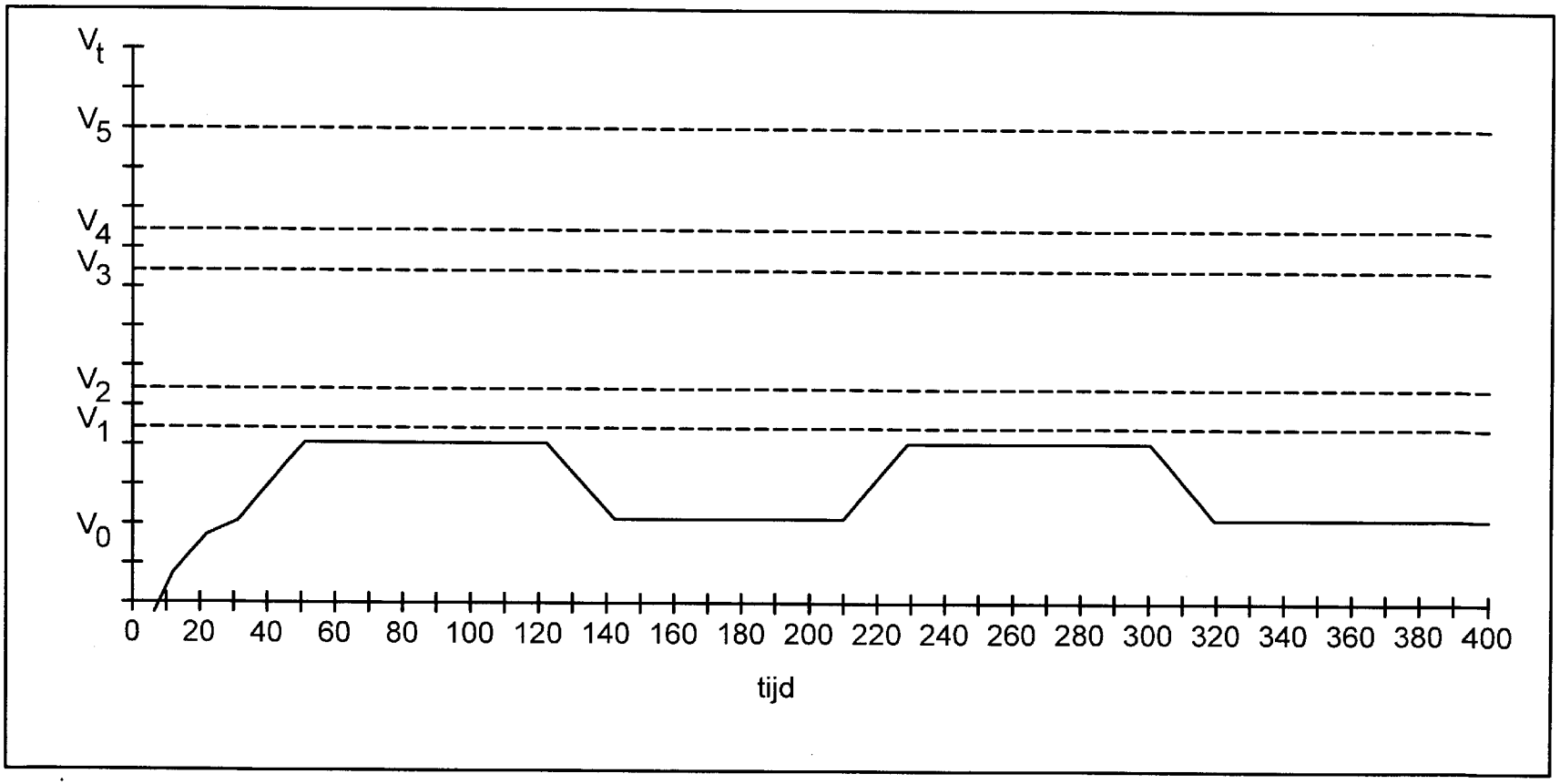
FIGS. 5 to 7 show the curve of the toner concentration voltage for a number of examples.

The effect of making one print on the curve of the toner concentration voltage will first be shown with reference to FIG. 5. The curve depicted in FIG. 5 shows $V_t$ as detected by the toner concentration sensor at location B (FIG. 3), level with the end of the development brush. The image for development in this example has a homogeneous degree of coverage such that during the time that development takes place the toner concentration voltage increases everywhere along the path AB by $\delta_1$ V/s. The image has a width corresponding to the width of the development roller and a length such that development takes place for 20 seconds. Development starts at the time t=30 s. Toner is taken off over the entire length AB, while at the same time the development mixture moves. From t=30 to t=50 the toner concentration voltage of the development mixer passing at B has a linear increase of $20*\delta_1$ V, the amount of toner withdrawn locally being in each case proportional to the time during which toner is withdrawn at the relevant continuing segment. From t=50 s no more toner is used and the development mixture passing at B will accordingly be found to have a constant toner concentration voltage in so far as toner is withdrawn from the mixture during the full 20 seconds. This is not the case for the development mixture supplied as from t=30 at location A with the nominal toner concentration. For 20 seconds this gives a linear decrease of the toner concentration voltage to the nominal value $V_0$. Since the development mixture moves from A to B in 90 seconds, this effect will become visible 90 seconds later, at t=120, at location B. In so far as the development mixture remains in circulation, this concentration curve will again pass location B after 180 seconds, as indicated in the drawing at the time t=210.

Figure 6:
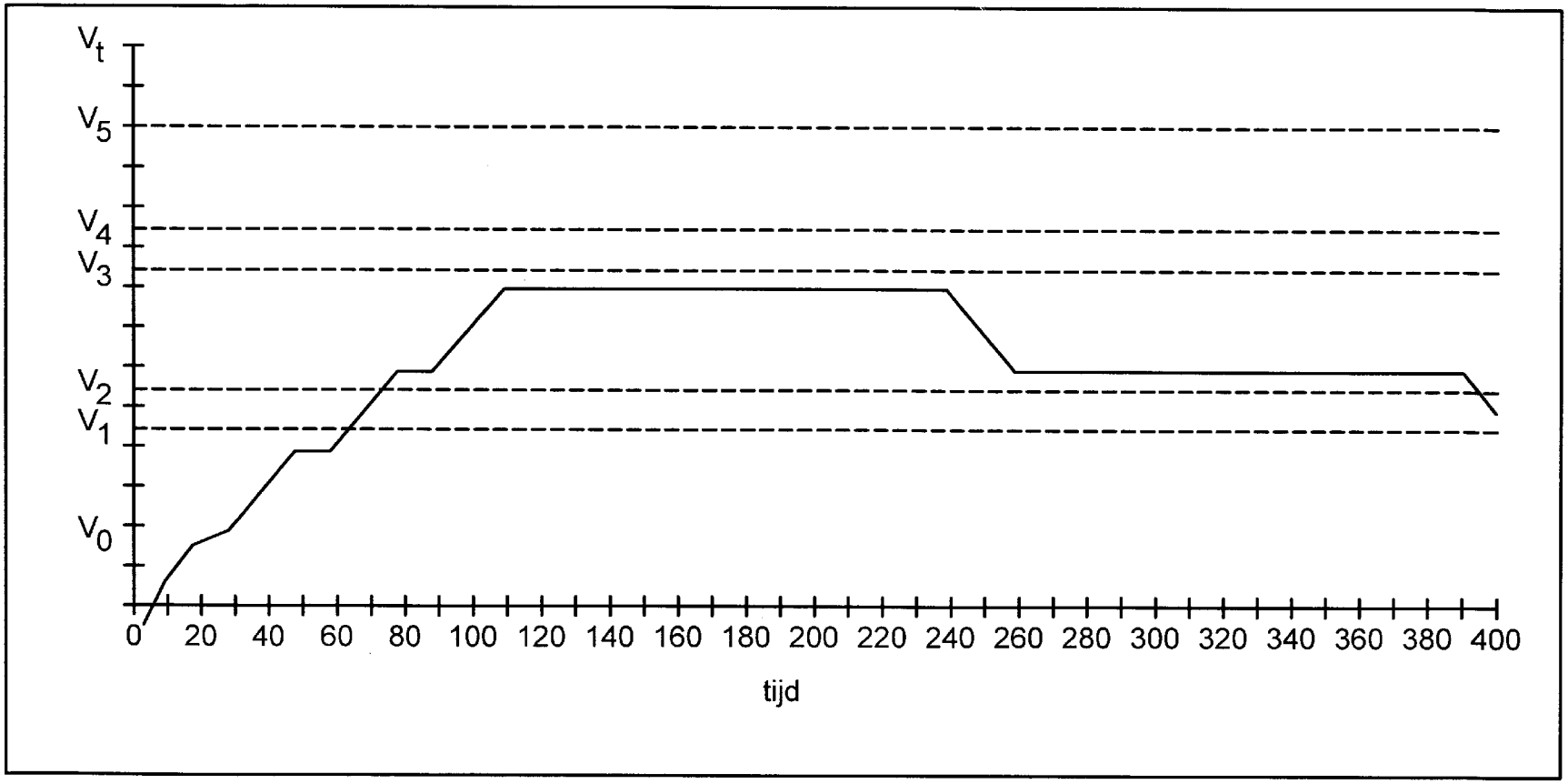

FIG. 6 shows the toner concentration voltage when carrying out a job consisting of six prints which start at the respective times t=30, 60, 90, 120, 150 and 180. Toner is withdrawn cumulatively from the development mixture. At the time t=65 $V_1$ is exceeded and toner supply starts from the supply tank. As a result, a decrease of the toner concentration voltage is caused locally to the value of $V_s$. It is assumed that in the example shown here $V_s=20*\delta_1$. $V_2$ is passed at the time t=75 s. From that time on the gradient is checked. The current gradient is $\delta_1$ V/sec. The threshold value for the gradient is $\Delta$ V/sec, where $\Delta>\delta_1$ so that no action is started. The curve is flat from t=110 to about t=240 s, whereafter the voltage decreases with $V_s$ because at that time, about 180 seconds after t=65 s and averaged out somewhat, the effect of the toner supply becomes visible at the sensor. Toner supply continues while no more toner is used so that the toner concentration voltage drops to a level below $V_1$ at which the toner supply is stopped.

Figure 7:
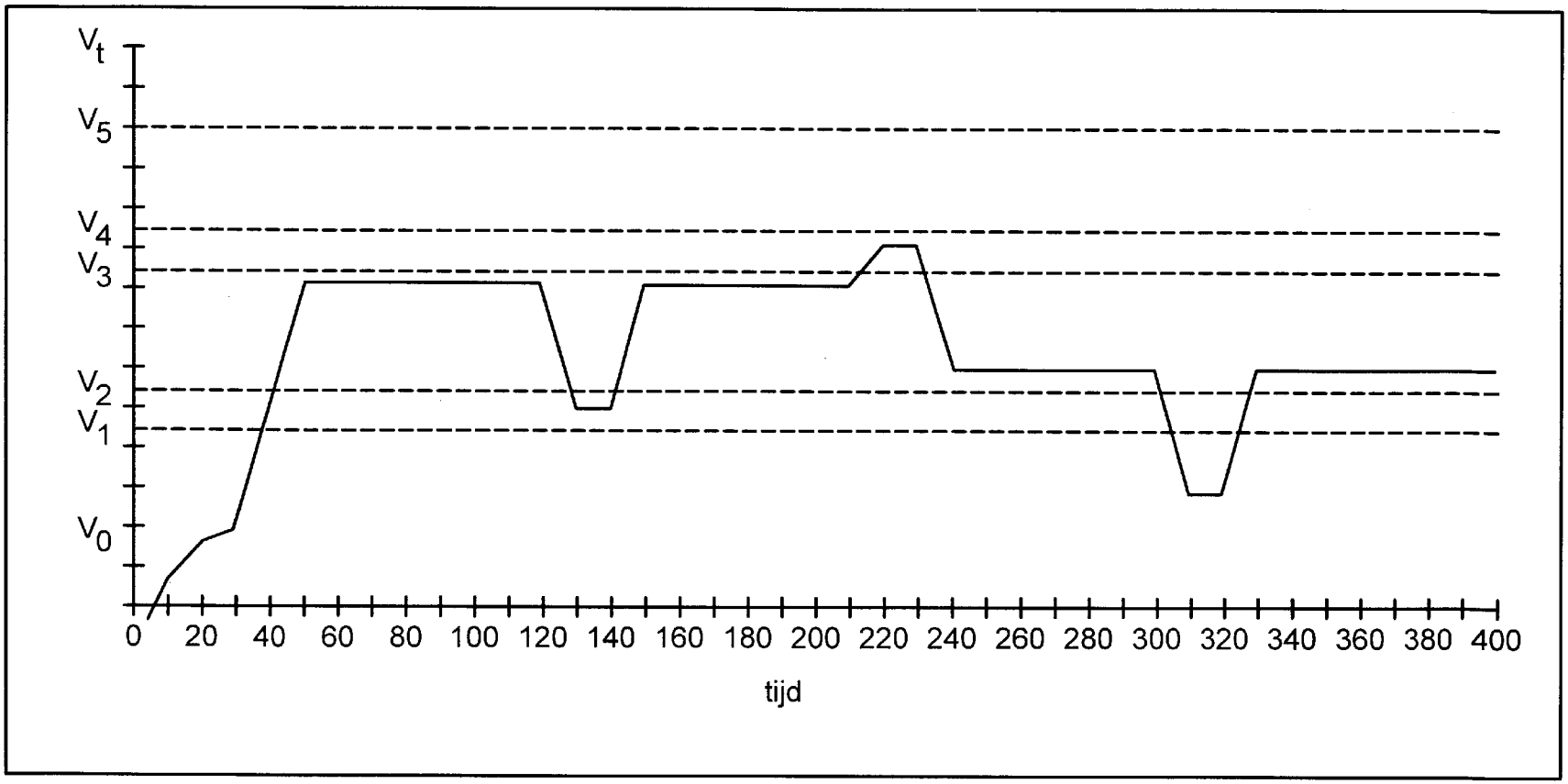

FIG. 7 shows the curve $V_t$ when making a number of prints with a degree of coverage three times greater than the prints of FIG. 6. As a result, everywhere along the path AB of reservoir 204 shown in FIG. 3 the toner concentration voltage increases by $3*\delta_1$ V/sec during the time that development is carried out. The first print starts at t=30. At the time t=38 the threshold value $V_1$ is passed, so that from that time on toner is supplied to the development mixture at C. This is not detected by the sensor until about 180 seconds later. At time t=42 s threshold value $V_2$ is passed, so that the gradient is checked from that moment on. It is assumed that $3*\delta_1<\Delta$. The gradient is above the threshold value so that the delayed-print mode starts. This means that the following print is delayed until $V_t$ has again dropped below the threshold value $V_2$. This is the case at t=130 s. Only then is a subsequent print started. The gradient is again checked here from the time t=142 s. The gradient is above the threshold value so that the delayed-print mode again starts. At the time t=302 s $V_t$ again drops below the threshold value so that a following print can again be started.

The effect of the steps according to the present invention is that in the making of prints having a high degree of coverage the delayed-print mode is switched on earlier than when prints are made with a low degree of coverage, so that productivity is retained as far as possible in the case of the latter while in the case of the former, due to the timely switching on of the delayed-print mode, the threshold value $V_4$ is prevented from being repeatedly passed, with prints having to be made afresh.

The invention is not limited to the embodiments for electrophotography given here, but is also applicable to feed mechanisms for supplying ink to inkjet heads in an inkjet reproduction apparatus, which mechanisms are also encompassed by the scope of the present invention.

What is claimed is:

1. A development unit for a reproduction apparatus for the selective application of marking agents to an image-forming medium comprising:

a first reservoir for storing marking agents, a second reservoir for maintaining a working stock of the marking agents, transfer means for the selective application of the marking agents present in the second reservoir to the image-forming medium, feed means for feeding the marking agents from the first reservoir to the second reservoir on the basis of a feed control signal, at least one sensor for the generation of a sensor signal corresponding to a quantity of the marking agents present in the second reservoir, and control means for generating the feed control signal on the basis of the sensor signal, wherein the control means comprise means for the generation of the feed control signal on the basis of a gradient of the sensor signal.

2. The development unit according to claim 1, wherein the generation of the feed control signal on the basis of the gradient of the sensor signal takes place only if the sensor signal is within a specific range.

3. The development unit according to claim 1, wherein the feed means comprise means for starting and stopping the supply of the marking agents from the first reservoir to the second reservoir on the basis of the feed control signal.

4. The development unit according to claim 1, wherein the second reservoir is constructed as a longitudinally extending tank for maintaining a working stock of the marking agents in the form of toner powder contained in a development mixture and the transfer means comprises a cylindrical magnetic brush rotatable about an axis extending in a longitudinal direction parallel to the longitudinally extending tank, wherein substantially the entire length of the magnetic brush projects at least partially into the second reservoir.

5. The development unit according claim 1, wherein the second reservoir extends in a longitudinal direction between a starting point and an end point and comprises two compartments extending in the longitudinal direction connecting with the starting point and the end point to form a toner circuit, each of the two compartments being provided with a rotatable, helical screw extending in the longitudinal direction and coupled to rotation means for effecting circulation of a development mixture through the toner circuit with a specific direction of circulation.

6. The development unit according to claim 5, wherein the feed means and the at least one sensor constructed as a toner concentration sensor are situated near the end point.

7. The reproduction apparatus provided with the development unit of claim 1, wherein the control means also comprises means for generating a special mode signal for initiating a special mode of the reproduction apparatus if the gradient of the sensor signal passes a first threshold value.

8. The reproduction apparatus according to claim 7, wherein the control means also comprises means for the generation of the special mode signal for initiating the special mode of the reproduction apparatus if the sensor signal passes a second threshold value.

9. The reproduction apparatus according to claim 8, wherein the special mode comprises finishing print jobs in progress and no longer accepting subsequent print jobs.

* * * * *